United States Patent [19]

Ikeda et al.

[11] Patent Number: 4,663,263

[45] Date of Patent: May 5, 1987

[54] TONER, CHARGE-IMPARTING MATERIAL AND COMPOSITION CONTAINING SUBSTITUTED GUANIDINE COMPOUND FOR ELECTROPHOTOGRAPHY

[75] Inventors: Takeshi Ikeda, Yokohama; Eiichi Imai, Narashino; Hiroshi Fukumoto, Kawasaki; Katsuhiko Tanaka, Tokyo; Koshi Suematsu, Kawasaki; Motoo Urawa, Tokyo; Masanori Takenouchi, Atsugi, all of Japan

[73] Assignee: Canon Kabushiki Kaisha, Tokyo, Japan

[21] Appl. No.: 789,016

[22] Filed: Oct. 18, 1985

[30] Foreign Application Priority Data

| | | | |
|---|---|---|---|
| Oct. 19, 1984 | [JP] | Japan | 59-220987 |
| Oct. 19, 1984 | [JP] | Japan | 59-220988 |
| Oct. 19, 1984 | [JP] | Japan | 59-220989 |
| Oct. 22, 1984 | [JP] | Japan | 59-222658 |
| Apr. 26, 1985 | [JP] | Japan | 59-88875 |
| May 14, 1985 | [JP] | Japan | 60-101749 |

[51] Int. Cl.[4] ..... G03G 9/08

[52] U.S. Cl. ..... 430/110; 430/106.6

[58] Field of Search ..... 430/110

[56] References Cited

U.S. PATENT DOCUMENTS

| | | | |
|---|---|---|---|
| 3,844,966 | 10/1974 | Nelson | 430/115 |
| 3,930,080 | 12/1975 | Tanimoto et al. | 428/704 X |
| 4,253,886 | 3/1981 | Aonuma et al. | 427/127 X |
| 4,554,233 | 11/1985 | Hashimoto et al. | 430/110 X |

*Primary Examiner*—J. David Welsh

*Attorney, Agent, or Firm*—Fitzpatrick, Cella, Harper & Scinto

[57] ABSTRACT

A triboelectrically chargeable composition for use in development of electrostatic latent images. The composition contains a substituted guanidine compound having at least one substituent group. The substituted guanidine compound is preferably one represented by the formula wherein $R^1$, $R^2$, $R^3$, $R^4$ and $R^5$ are the same or different groups including hydrogen atom, alkyl, cycloalkyl, alkenyl, aryl, aralkyl, alkaryl, and heterocyclic groups, of which a hydrogen atom may be further replaced by a substituent group, and at least one of $R^1$, $R^2$, $R^3$, $R^4$ and $R^5$ is a group other than hydrogen. The composition is embodied typically as a positively chargeable toner and also as a charge-imparting material for charging a toner.

12 Claims, 1 Drawing Figure

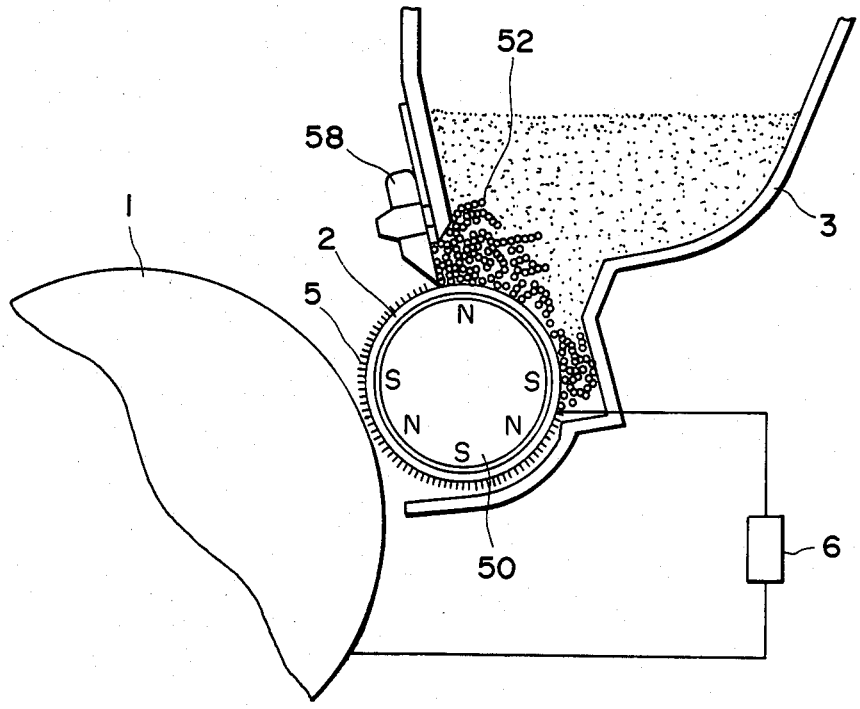
52
58
1
2
3
5
N
S
S
N
N
S
50
6

TONER, CHARGE-IMPARTING MATERIAL AND COMPOSITION CONTAINING SUBSTITUTED GUANIDINE COMPOUND FOR ELECTROPHOTOGRAPHY

FIELD OF THE INVENTION AND RELATED ART

The present invention relates to a toner used in a developer for developing electrostatic images in electrophotography, electostatic recording and electrostatic printing, more particularly to a toner for developing electrostatically charged images containing a substituted guanidine compound, which is uniformly and strongly charged positively to visualize negatively charged electrostatic image or visualize positively charged electrostatic image through reversal development, thereby providing high-quality images.

Further, the present invention relates to an electric charge-imparting material for imparting triboelectric charge to a developer containing a substituted quanidine compound for developing electrostatic images in electrophotography, electrostatic recording and electrostatic printing.

Furthermore, the present invention relates to a triboelectrically chargeable composition containing a substituted guanidine compound for use in development of electrostatic images to form a visible image in electrophotography, electrostatic recording and electrostatic printing.

Hitherto, a large number of electrophotographic processes have been known, as disclosed in U.S. Pat. Nos. 2,297,691; 4,071,361, and others. Generally speaking, photoconductive materials are utilized in these processes, and the steps included therein comprise forming electrical latent images on photosensitive members by various means, then developing the latent images by using developing powder (frequently called as "toner"), transferring the toner images thus formed to a recording medium such as paper, as desired, and thereafter fixing the images by heating, pressure or solvent vapor to obtain copies. When the step of transferring the toner images is adopted, it is a general practice to provide a step for removing residual toner on the photosensitive member.

The developing methods for visualizing electrical latent images by use of toners known in the art may include, for example, the magnetic brush method as disclosed in U.S. Pat. No. 2,874,063; the cascade developing method as disclosed in U.S. Pat. No. 2,618,552; the powder cloud method as disclosed in U.S. Pat. No. 2,221,776; and the method using conductive magnetic toner as disclosed in U.S. Pat. No. 3,909,258.

As the toner for dry development system to be applied for these developing methods, fine powder of natural or synthetic resins having dyes or pigments dispersed therein has heretofore generally been used. For example, a colorant is dispersed in a binder resin such as polystyrene, and the particles obtained by micropulverizing the resultant dispersion into sizes of about 1 to 30 microns are used as the toner. As the magnetic toner, magnetic particles are further incorporated into the particles as mentioned above. In case of the system employing the two-component developer, the toner as mentioned above is used generally in mixture with carrier particles such as glass beads and iron particles.

For such a toner for dry-system development, it has been becoming a general practice to use a positive or negative charge controlling agent in order to improve the charging characteristic.

Positive charge controllers conventionally used in toners for dry development system, may include, for example, quaternary ammonium compounds and organic dyes, particularly basic dyes and salts thereof including nigrosine base and nigrosin. These charge controllers are usually added to a thermoplastic resin to be dispersed in the resin while it is molten under heating, and the resultant resin mixture is micropulverized into fine particles and, if desired, adjusted to suitable sizes. The conventional charge controllers have been composed of such coarse particles that 30 % by number or less thereof have particle sizes which are 1/5 or smaller of the average particle size of the toner to be used in combination.

However, these conventional charge controllers are liable to cause lowering in the charge controlling characteristic, when subjected to mechanical collision and friction during kneading under heat to change in temperature and humidity conditions.

Accordingly, when a toner containing these charge controllers is used in a copying machine to effect development, the toner can cause deterioration during continual use.

Further, these conventional charge controllers, as represented by nigrosine, show dense colors which provide a serious obstacle to formation of toners in bright chromatic colors.

As another serious disadvantage, it is very difficult to disperse these charge controllers evenly into a thermoplastic resin, and their contents in toner particles obtained by pulverization are not constant to result in different amounts of triboelectric charges among the toner particles. For this reason, in the prior art, various methods have been practiced in order to disperse the charge controlling more evenly into a resin. For example, a basic nigrosine dye is formed into a salt with a higher fatty acid for improvement of compatibility with a thermoplastic resin. In this case, however, unreacted fatty acid or decomposed product of the salt will be exposed on the toner surfaces to contaminate carriers or toner carrying member and also cause lowering in free flowing properly of the toner, fog and lowering in image density. Alternatively, for improvement in dispersibility of these dyes into a resin, there is also employed a method in which powder of a charge controller and resin powder are previously mechanically pulverized and mixed before fusion kneading. This method is not competent enough to overcome the original poor dispersibility, and evenness of charging satisfactory in practical application has not yet been obtained.

More specifically, when such a conventional charge controller is used in a toner, uneven or different amounts of charge are provided to individual toner particles through friction between toner particles, toner and carrier particles, or toner and a toner-carrying member such as a sleeve, whereby an undesirable phenomenon such as developing fog, toner scattering or carrier contamination is liable to occur. Such an undesirable phenomenon is pronounced when copying is repeated for a large number of times, thereby to render the toner substantially unsuitable for copyng. Further a toner thus obtained has a remarkably lower transfer efficiency under a high humidity condition and is thus unfit for a practical use.

Furthermore, when such a toner containing a conventional charge controller is used for a long time, sticking of toner is promoted due to insufficient charge to result in an undesirable influence to formation of latent images (filming), or an ill effect to a cleaning step in copying operation such as formation of flaws on a photosensitive member or a cleaning member such as a cleaning blade or promotion of wearing of these members is caused.

Thus, the use of conventional charge controllers involves many problems, the dissolution of which is earnestly expected in this technical field. While there have been many proposals for improvement, a charge controller satisfying practical requisites as a whole has not been obtained.

In order to have a toner acquire an electric charge, a method of utilizing only the triboelectric chargeability of the toner per se has been known as described above. In this method, however, the chargeability of the toner is small unless it contains an appropriate charge controller, the image obtained by such a toner is liable to be accompanied with fog and unclear. For this reason, there has been proposed to impart triboelectric charge by a movement or carriage-regulating member such as magnetic particles, a carrier, a sleeve or a doctor blade, or a developing material or member for charging. The developing material or member for charging is a material or member for imparting or auxiliarily imparting a triboelectric charge to a toner through contact with the toner.

If such a charge-imparting material having a charge imparting ability is used, the necessity for a toner a contain an additive for controlling the chargeability of the toner, i.e., a charge controller, is minimized, whereby contamination of a carrier or a photosensitive member with the additive is minimized. Therefore, lowering of chargeability or disturbance of latent images during a successive copying operation is minimized, so that even a color toner can readily be charged.

However, in order to provide a good charge-imparting property to a movement-regulating material such as magnetic particles, a carrier, sleeve or doctor blade, or a developing member for charging, it is necessary to use a substance or compound which can provide a strong charge-imparting ability and also can be applied or coated onto the material or can be dispersed in the material. In this regard, the carrier particles are generally used for a long period of time without exchange, and the sleeve is used until the main body of a copier cannot be used, so that they must be mechanically tough and durable for a long period of time. Thus, a good additive for improving a charge-imparting characteristic of such a charge imparting for supplementing the chargeability of toner is also expected.

SUMMARY OF THE INVENTION

A principal object of the present invention is to provide a new technique for dissolving the above mentioned problems in the field of controlling electric charge of a toner.

Another object of the present invention is to provide a developer which can be provided with a stable amount of and a sharp and uniform distribution of triboelectric charge through friction between toner particles, between toner and carrier or between toner and a toner-carrying member such as a sleeve in case of one-component development system and can be controlled to have a triboelectric charge in an amount adapted to a developing system to be used.

A still further object of the invention is to provide a developer capable of effecting development and transfer faithful to latent images, i.e., a developer capable of realizing a high image density and a good reproducibility of a half tone without causing sticking of the toner to a background region, fog or scattering of the toner in the neighborhood of latent image contour during development.

A further object of the invenion is to provide a developer which retains initial performances without causing agglomeration or change in charging characteristic of the toner even when the developer is continually used for a long time.

A still another object of the invention is to provide a toner which reproduces a stable image not readily be affected by change in temperature and humidity, particularly a developer having a high transfer efficiency without causing scattering or transfer drop-off during transferring under a high humidity or a low humidity.

A further object of the invention is to provide a developer with excellent storage stability which can retain initial characteristics even after a long period of storage.

A further object of the invention is to provide a bright chromatic developer.

A still further object of the invention is to provide a developer which facilitates a cleaning step without staining, abrading or flawing an electrostatic latent image-bearing surface.

Another object of the invention is to provide a developer with a good fixation characteristic, particularly a developer with no problem in respect of high-temperature offset.

A still further object of the present invention is to provide a charge-imparting material or member improved in charge-imparting capability for imparting an appropriate amount of negative charge to a toner.

A further object of the invention is to provide an improved charge-imparting material which is less liable to deteriorate in its performance during a long period of use.

A still further object of the invention is to provide a charge-imparting material or member adapted to a chromatic toner.

A generic object of the present invention is to provide of a triboelectrically chargeable composition inclusive of a toner for developing electrostatic images and a charge-imparting material or member with characteristics as described above.

According to a principal aspect of the present invention, there is provided a positively chargeable toner for developing electrostatic images comprising a binder, a colorant and a substituted guanidine compound having at least one substituent group.

According to another aspect of the present invention, there is provided a charge-imparting material comprising a substituted guanidine compound having at least one substituent group and a base material carrying the compound. Herein, the term "charge-imparting material" is intended to cover materials having a function of imparting triboelectric charge to a toner, which are in the form of particles such as magnetic particles or carrier particles used in combination with a toner to form a two-component developer or a solid member such as a doctor blade, a toner-carrying member such as a sleeve, and other members which contact a toner before or during a developing step. The term "carrying" has been used to cover the cases where the subsituted guanidine compound is dispersed in the base material which may be in the form of particles or a solid member as described above, or carried as a coating on the surface or an embedded substance in the surface layer of the base material.

According to a broader and generic aspect of the present invention, there is provided a triboelectricallly chargeable composition comprising the above mentioned subsitituted guanidine compound and a base material carrying the compound. Herein, the term "composition" has been used to cover the toner and the charge-imparting material as described above. Accordingly, the term "base material" used herein is intended to cover materials in the form of particles inclusive of particles constituting toners and carrier particles. The term "carrying" has the same meaning as described above.

These and other objects, features and advantages of the present invention will become more apparent upon a consideration of the following description of the preferred embodiments of the present invention taken in conjunction with the accompanying drawing.

BRIEF DESCRIPTION OF THE DRAWING

The sole figure in the drawing schematically illustrates a developing apparatus which is used to effect development by using a toner according to the present invention.

DETAILED DESCRIPTION OF THE INVENTION

The present invention is based on our discovery of the facts as follows. Thus, a substituted guanidine compound is stable both thermally and against the lapse of time, little hygroscopic and colorless or substantially colorless. Therefore, when it is contained in a toner, the hue of a colorant in the toner is not deteriorated thereby, so that the toner can present a bright chromatic color. Based on these characteristics and the fact that it can appropriately control the charge of the toner, a substituted guanidine compound can be a good positive charge controller.

Examples of the substituted guanidine compound include those represented by the following formula (I):

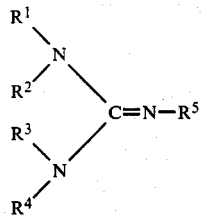

(I)

wherein $R^1$, $R^2$, $R^3$, $R^4$ and $R^5$ are the same or different groups including hydrogen atom, alkyl, cycloalkyl, alkenyl, aryl, aralkyl, alkaryl, and heterocyclic groups, of which a hydrogen atom may be further replaced by a substituent group, and at least one of $R^1$, $R^2$, $R^3$, $R^4$ and $R^5$ is a group other than hydrogen.

The substituted guanidine compound to be used in the present invention should preferably be those expressed by the following formula (II)

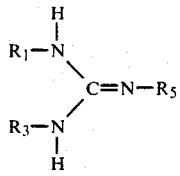

(II)

wherein $R_1$ and $R_3$ are the same as above except that hydrogen is excluded and $R_5$ is the same as described above. It is preferred that $R_1$ and $R_3$ are respectively an aryl group in a broad sense inclusive of aryl, alkaryl and aralkyl, more preferably one having 6–30 carbon atoms and $R_5$ is an electron-donating group other than hydrogen. $R_5$ is more preferably an alkyl group having 1 to 20 carbon atoms or an aryl group having 6–30 carbon atoms in view of good compatibility with the binder resin and positive chargeability. The substituent group which may be attached to the groups $R_1$–$R_5$ may be halogen, alkyl, alkenyl, alkynyl, alkoxy ester, alkoxycarbonyl, phenyl, hydroxy, mercapto, alkylmercapto, amino, acyl, acylamino, nitro, imino, phenylimino, cyano, azo, diazoamino, ureido, oxo or heterocyclic ring group. These groups may further contain a substituent group.

Specific examples of the substituted guanidine compounds represented by the general formula (I) are enumerated hereinbelow.

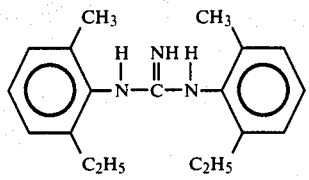

(1)

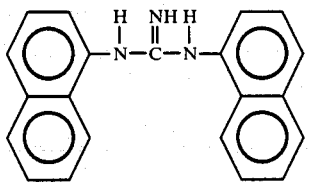

(2)

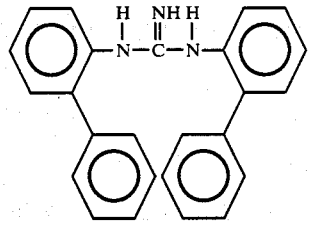

(3)

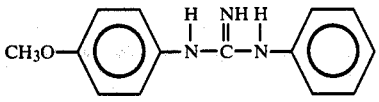

(4)

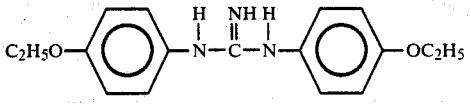

(5)

-continued
(6)
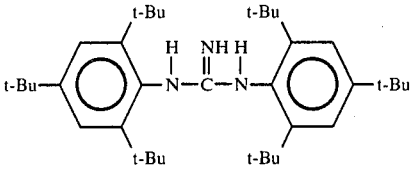
(7)
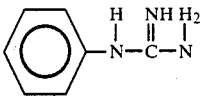
(8)
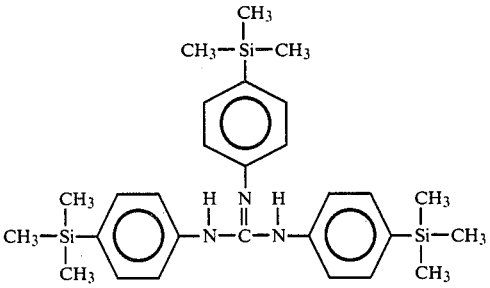
(9)
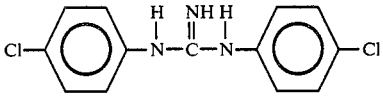
(10)
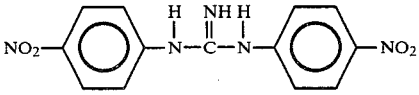
(11)
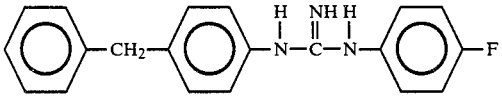
(12)
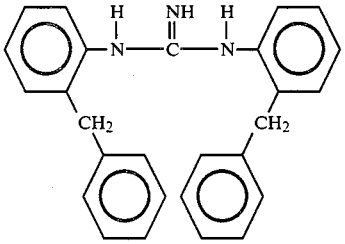
(13)
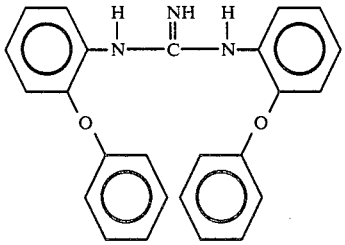
(14)
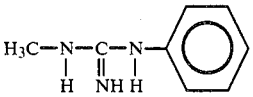
-continued
(15)
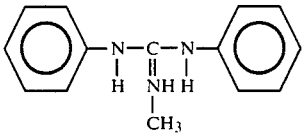
(16)
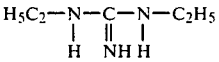
(17)
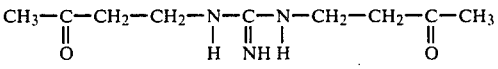
(18)
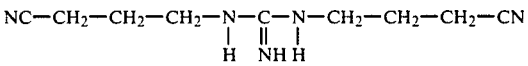
(19)
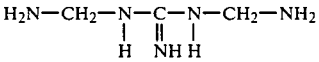
(20)
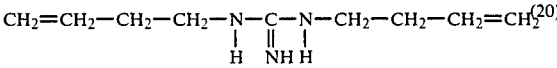
(21)
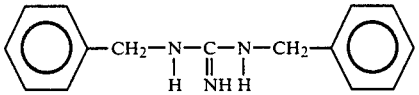
(22)
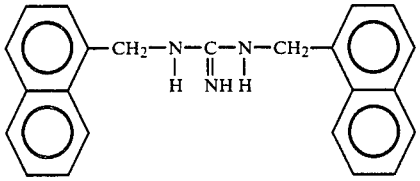
(23)
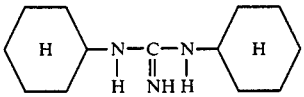
(24)
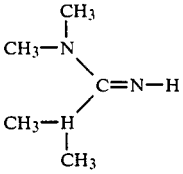
(25)
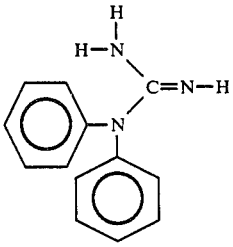

-continued
(26)
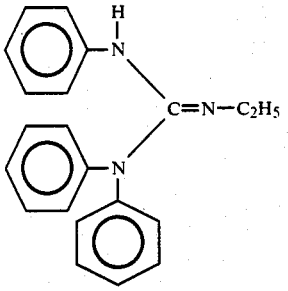
(27)
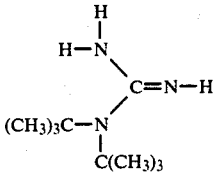
(28)
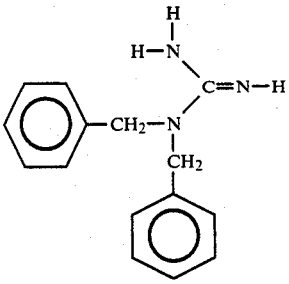
(29)
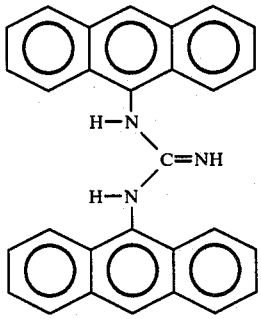
(30)
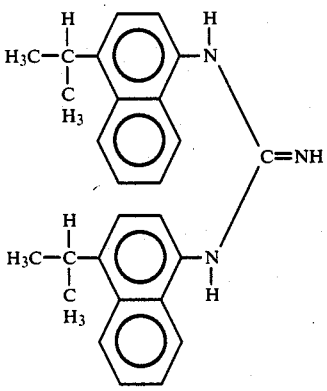
-continued
(31)
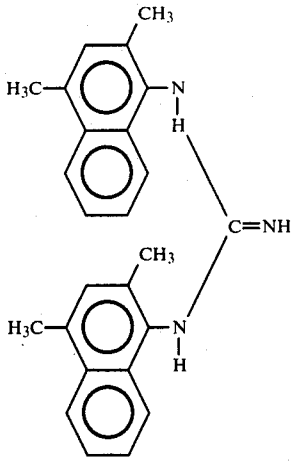
(32)
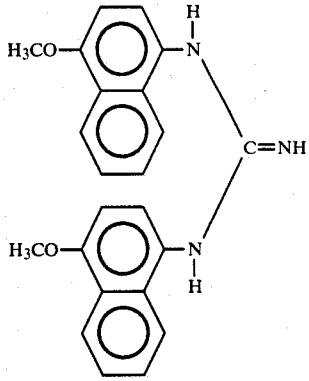
(33)
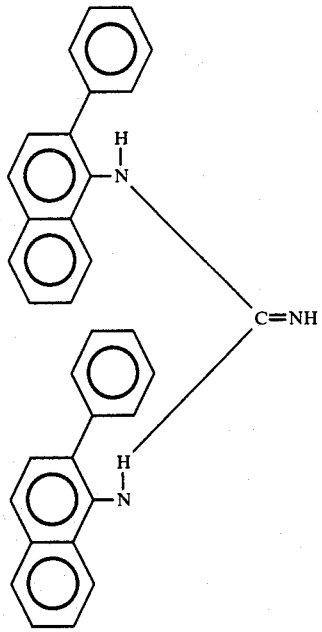

-continued
(34)
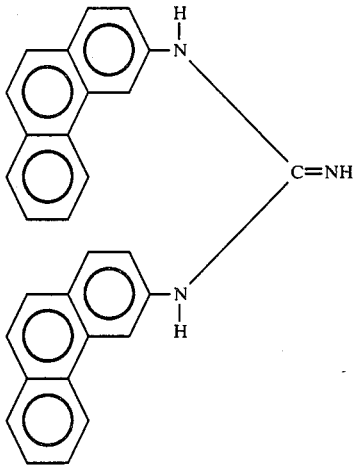
(35)
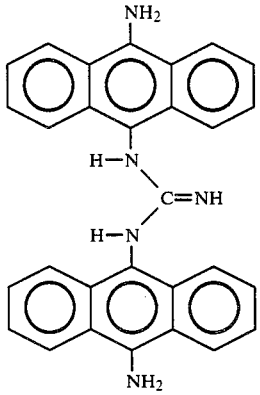
(36)
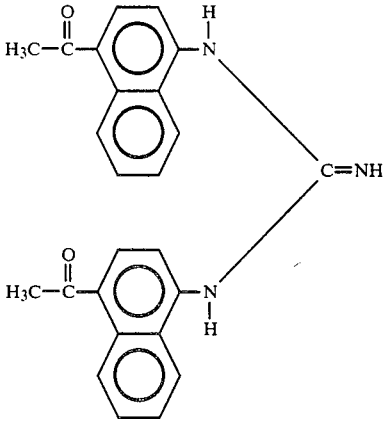
-continued
(37)
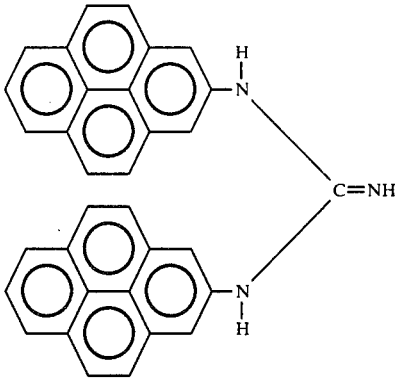
(38)
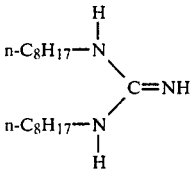
(39)
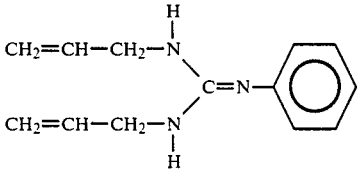
(40)
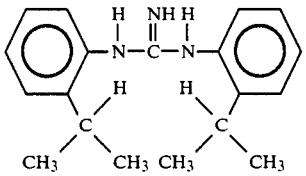
(41)
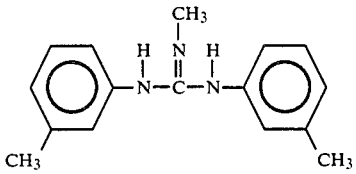
(42)
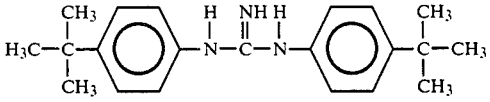
(43)
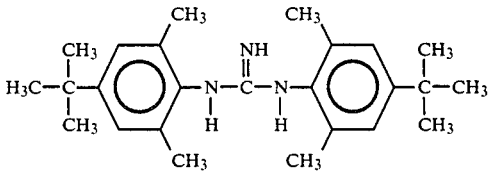
(44)
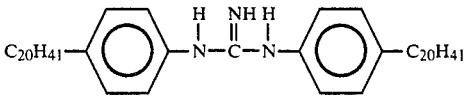

-continued (45)

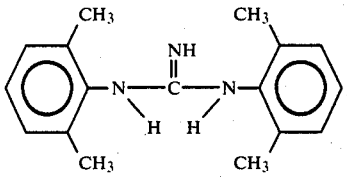

(46)

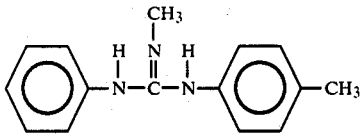

(47)

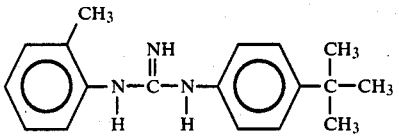

(48)

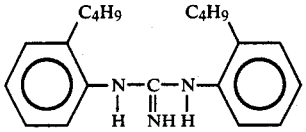

(49)

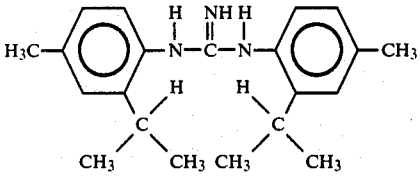

(50)

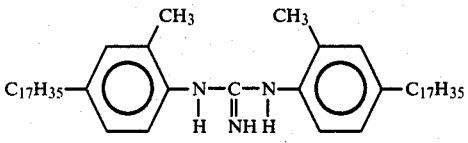

(51)

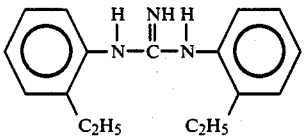

(52)

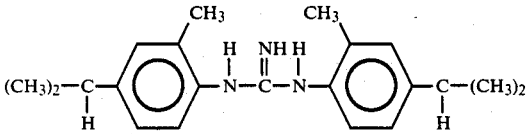

(53)

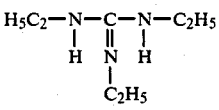

(54)

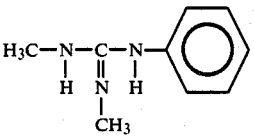

(55)

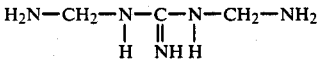

-continued (56)

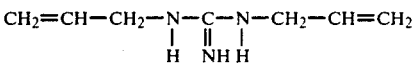

(57)

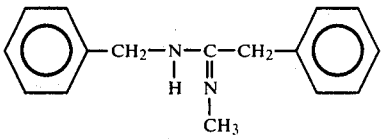

(58)

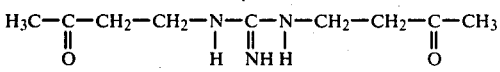

(59)

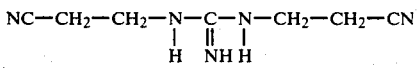

(60)

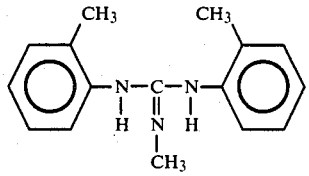

(61)

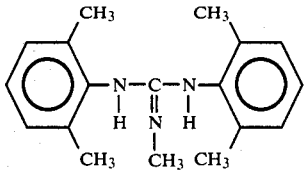

(62)

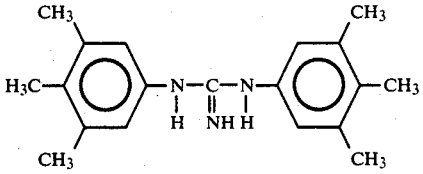

(63)

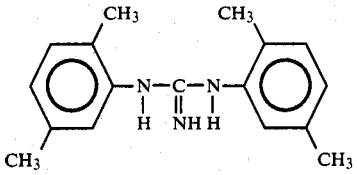

(64)

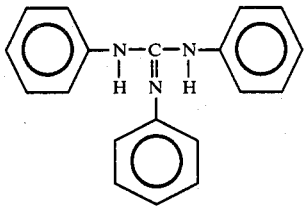

Hereinbelow, some examples of methods for production of the substituted guanidine compound to be used in the present invention will be described.

While a mixture solution containing an alkyl derivative of aniline and water is heated in an autoclave to about 90°-110° C., cyanogen chloride is introduced thereinto and heating is continued for several hours. Thereafter, an excessive amount of the alkyl derivative of aniline is removed by steam distillation and then sodium hydroxide is added for neutralization to precipitate an objective compound.

More specifically, di-(o-isopropylphenyl)guanidine (Compond Example (40) as mentioned before) may be produced as follows. While a mixture solution containing o-isopropylaniline (produced by Tokyo Kasei Kogyo K.K.) and water is heated to about 100° C. in an autoclave, cyanogen chloride (as produced by introducing chlorine into an ice-water solution of potassium cyanide) is introduced and heating is continued for 3–5 hours. Then, an excessive amount of oisopropylaniline is removed by steam distillation, followed by addition of an aqueous solution of sodium hydroxide to precipitate the objective compound. Thus, di-(o-isopropylphenyl)-guanidine was obtained as white powder showing a melting poin of 168.5°–172.0° C.

N,N'-di(o-tolyl-N''-methylguanidine (Compound Example (60) may be prepared by reacting 2-methyl-aniline with carbon sulfide at 100° C. and then with methylamine. The reactions are expressed by the following scheme:

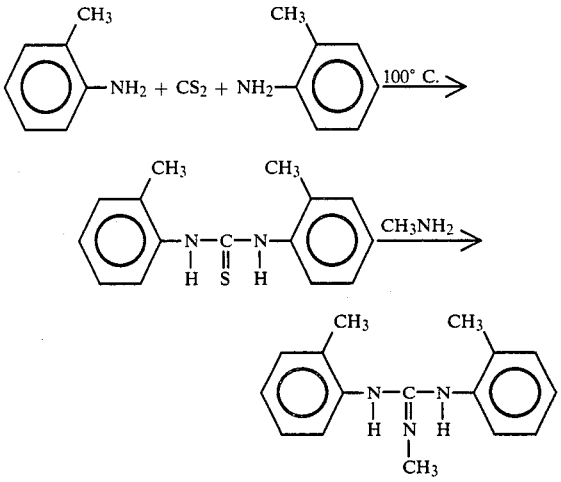

Compound Example (24) may be formed by reacting guanidine (reagent grade) dissolved in methanol with methyl iodide in a sealed tube.

Compound Example (25) may be formed by an addition reaction between diphenyl cyanamide and ammonia along the following scheme:

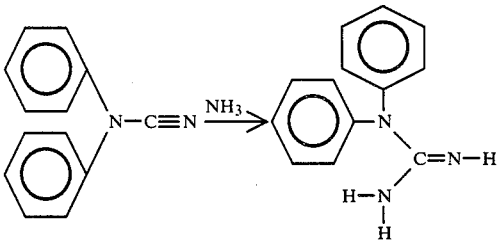

The above compound may be added to the toner internally (incorporated inside the toner particles) or externally as by dry mixing. In the case of the internal addition, the amount of the compound to be added may depend on several factors involved in a toner production process including kind of binder resin, optionally used additive and method of dispersion and are not determinned in a single way. However, when other performances are also taken into consideration, the compound should preferably be used in a proportion of 0.1 to 10 wt. parts, more preferably 0.5 to 5.0 wt. parts, per 100 wt. parts of the binder resin.

In the case of the external addition, the compound should preferably be used in a proportion of 0.01 to 10 wt. parts, particularly 0.5 to 5 wt. parts, per 100 wt. parts of the binder resin.

A conventional charge controller may be used in combination with the charge controller compound according to the invention as far as it does not provide a harmful effect to the toner according to the invention. In this case, however, the conventional charge controller should be used in a smaller quantity than that of the compound according to the present invention in order to provide a better result.

The charge controller compound according to the present invention may of course be used in combination with a colorant to form a toner of a desired color. In this case, as the compound according to the invention has a high degree of whiteness, it accentuates the color of a colorant used in combination and also can reduce the amount of the colorant.

The colorant to be used in the present invention may be one or a mixture of known dyes or pigments including Carbon Black, Lamp Black, Iron Black, ultramarine blue, Aniline Blue, Phthalocyanine Blue, Phthalocyanine Green, Hansa Yellow G, Rhodamine 6G Lake, Chalcooil Blue, Chrome Yellow, Quinacridone, Benzidine Yellow, Rose Bengal, triarylmethane dyes, monoazo and disazo dyes.

The binder resin for the toner of the present invention may be composed of homopolymers of styrene and derivatives thereof such as polystyrene, poly-p-chlorostyrene and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer and styrene-dimethylaminoethyl methacrylate copolymer; polymethyl methacrylate, polybutyl methacrylate, polyvinyl chloride, polyvinyl acetate, polyethylene, polypropylene, polyesters, polyurethanes, polyamides, epoxy resins, polyvinyl butyral, polyacrylic acid resin, rosin, modified rosins, terpene resin, phenolic resins, aliphatic or alicyclic hydrocarbon resins, aromatic petroleum resin, chlorinated paraffin, paraffin wax, etc. These binder resins may be used either singly or as a mixture. When the positive chargeability and fixability of the toner is taken into consideration, a copolymer of two or more members selected from styrene, acrylates and methacrylates is preferred, inclusive of styrene-an acrylate copolymer styrene-a methacrylate copolymer, an acrylate-a methacrylate copolymer, copolymer of two or more acrylates and copolymer of two or more methacrylates.

The following binder resins may suitably be used singly or as a mixture, in particular, for providing a pressure-fixable toner:

Polyolefins such as low molecular-weight polyethylene, low molecular-weight polypropylene, polyethylene oxide and poly-4-fluoroethylene waxes such as polyethylene wax and paraffin wax; epoxy resin, polyester resin, styrene-butadiene copolymer (monomer ratio 5-30:95-70), olefin copolymers such as ethylene-acrylic acid copolymer, ethylene-acrylate copolymers, ethylene-methacrylic acid copolymer, ethylene methacrylate copolymers, ethylene-vinyl chloride copolymer, ethylene-vinyl acetate copolymers and ionomer resins); polyvinyl pyrrolidone, methyl vinyl ether-maleic anhydride copolymer, maleic acid-modified phenolic resin, and phenol-modified terpene resin.

The toner according to the present invention may be mixed with carrier particles to form a two-component developer. The carrier particles to be used for this purpose may be those known in the art including, for example, powder or particles of metals such as iron, nickel, aluminum and copper, alloys of these metals or metal compounds including oxides of these metals; and powder or particles of ceramics such as glass, SiC, $BaTiO_2$ and $SrTiO_2$. These particles may be coated with a resin, etc. Alternatively, resin particles or resin particles containing a magnetic material may also be used.

The toner according to the invention may be composed as a magnetic toner by incorporating therein a magnetic material. The magnetic material to be used for this purpose may be one or a mixture of: iron oxides such as magnetite, hematite and ferrite; metals such as iron, cobalt and nickel, alloys of these metals with metals such as aluminum, cobalt, copper, lead, magnesium, tin, zinc, antimony, beryllium, bismuth, cadmium, calcium, manganese, selenium, titanium, tungsten and vanadium.

These magnetic materials may preferably be in the form of particles having an average particle size of the order of 0.1 to 2 microns and be used in the toner in an amount of about 20–200 wt. parts, particularly 40–150 wt. parts, per 100 wt. parts of the resin component.

Another optional additive may be added externally or internally to the toner so that the toner will exhibit further better performances. Optional additives to be used as such include, for example, lubricants such as teflon and zinc stearate; abrasives such as cerium oxide and silicon carbide; flowability improvers such as colloidal silica and aluminum oxide; anti-caking agent; conductivity-imparting agents such as carbon black and tin oxide; or fixing aids such as low molecular-weight polyethylene.

These additives may preferably have the same triboelectric polarity as the toner or have almost no triboelectric chargeability in order to have the toner fully exhibit its effect.

The toner for developing electrostatic images according to the present invention may be produced by sufficiently mixing the charge controller compound according to the invention with a vinyl or non-vinyl thermoplastic resin such as those enumerated hereinbefore, a pigment or dye as a colorant and, optionally, a magnetic material, an additive, etc., by means of a mixer such as a ball mill, etc.; then melting and kneading the mixture by hot kneading means such as hot rollers, kneader and extruder to disperse or dissolve the pigment or dye, the charge controller and optional additives, if any, in the melted resin; cooling and crushing the mixture; and subjecting the powder product to classification to form toner particles having an average particle size of 5 to 20 microns.

Alternatively, another method may be used such as a method of dispersing in a solution of the binder resin the other prescribed components and spray-drying the dispersion; a method of mixing in a monomer providing the binder resin the other prescribed ingredients to form a suspension and polymerizing the suspension to obtain a toner; or a method providing a capsule toner comprising a core and a shell.

The thus obtained toner according to the present invention may be used as a positively chargeable toner in known manners for developing electrostatic latent images obtained by electrophotography, electrostatic recording, electrostatic printing, etc., to visualize the latent images, whereby advantageous effects as described below are attained.

Because the substituted guanidine compound according to the invention is contained, individual particles of the toner are caused to have a uniform triboelectric charge, and the amount of the charge is easily controlled and does not cause fluctuation or decrease. Thus, a very stable toner is obtained. Accordingly, undesirable phenomena are obviated such as development fog, toner scattering, and contamination of a photosensitive material for electrophotography and a copier. Further, the toner according to the present invention containing a compound having a charge-controlling polar group is excellent in physical properties and does not cause agglomeration, blocking or low-temperature fluidization. Thus, the toner can withstand a long period of storage, and the toner image is also excellent in abrasion resistance, fixation characteristic and adhesion characteristic.

These advantageous effects of the toner according to the invention are more fully exhibited when it is used in a repetitive transfer-type copying system wherein charging, exposure, developing and transfer operations are continuously and repetitively carried out. Further, as the substituted guanidine compound used as a charge controller does not provide little hindrance to color hue, so that the toner can provide an excellent chromatic color image when formulated as a toner for color electrophotography.

Hereinabove, the toner according to the present invention which is a typical and most preferred embodiment of the triboelectrically chargeable composition according to the present invention, has been fully described with respect to its ingredients, production process and use thereof. However, the triboelectrically chargeable composition according to the present invention may also be embodied as a charge-imparting material (or member) or toner movement-regulation material inclusive of magnetic particles, a carrier, a doctor blade, a toner-carrying member such as a sleeve by utilizing an excellent positive chargeability of the substituted guanidine compound according to the invention. The charge-imparting material may be defined as a solid material which imparts or supplements a charge necessary for development to a toner while contacting the toner prior to or during the developing step.

In order to provide the charge-imparting material according to the invention, the substituted guanidine compound according to the invention may be applied as a coating on or dispersed or incorporated in a base material which may be in the form of carrier particles or a fixed member such as a doctor blade or sleeve.

For this purpose, the charge controller compound, i.e. the substituted guanidine compound according to the invention, may be used as such in the form of particles, or dispersed in a solvent or dispersant, or otherwise dispersed in a resin or a solution thereof. Powder of a ceramic material such as silica, aluminum oxide, cerium oxide or silicon carbide may be added to the above as a filler. Further, a conductivity imparting agent such as carbon black or tin oxide may be added to control the conductivity. In order to avoid the deposition or accumulation of spent toner on the sleeve or carrier particles as embodiments of the charge-imparting material, a releasing agent such as an aliphatic acid metal salt or polyvinylidene fluoride may be added.

As the resin for carrying or dispersing the charge controller compound according to the present invention may be those generally used including polystyrene, polyacrylic acid esters, polymethacrylic acid esters, polyacrylonitrile, rubber resins such as polyisoprene and polybutadiene, polyester, polyurethane, polyamide, epoxy resin, rosin, polycarbonate, phenolic resin, chlorinated paraffin, polyethylene, polypropylene, silicone resin, teflon, etc. Derivatives of these resins, copolymers of constituted monomers of these resins and mixtures of these resins may also be used.

The coating amount or content of the charge controller compound on the surface or in the surface layer of the charge-imparting material for development of electrostatic images which may be carrier particles, magnetic particles a sleeve or a doctor blade, should be appropriately controlled and preferably be 0.01–10 $mg/cm^2$, particularly 0.01–2 $mg/cm^2$.

The carrier particles as an embodiment of the charge-imparting material, particularly the base material thereof, may be those as described above to be combined with the toner according to the invention.

The sleeve as another embodiment of the charge-imparting material may be formed of, for example, metals such as iron, aluminum, stainless steel and nickel or alloys of these metals. Further, the sleeve may be formed of a non-metallic substance such as ceramics and plastics.

In order to produce the charge-imparting material, for example, the carrier particles may be obtained by dipping the base or core particles in a dispersion of the charge-imparting compound in a resin solution or dispersion or applying the dispersion to the base particles, and thereafter drying the coated particles, as desired.

The sleeve may be obtained by applying the dispersion of the charge-imparting compound as described above by dipping, spraying, brush coating.

Alternatively, the charge-imparting compound according to the invention may be dispersed in a shapable resin to form carrier particles, a sleeve or a doctor blade.

The present invention will be more specifically explained with reference to examples, while it is to be understood that the present invention is not limited to the specifically described examples. In the examples, "parts" used for describing formulations are all by weight.

EXAMPLE 1

Styrene-butyl methacrylate copolymer: 100 parts
Phthalocyanine-type blue dye: 10 parts
Substituted guanidine compound (15): 3 parts With 100 parts of a toner having the above composition and an average particle size of 9 microns was mixed 1000 parts of iron powder carrier to form a developer. The toner in the developer showed a good positive chargeability.

The developer was used in a copying machine (NP-8500, mfd. by Canon K.K.) to effect imaging, whereby a good image showing clear blue color was obtained and the image was a practically acceptable image even after 200,000 sheets of imaging. The transfer efficiency was as good as 90% or above.

Images with substantially no difference from those under the normal temperature and normal humidity conditions were obtained under the high temperature-high humidity conditions of 35° C.—90% RH and the low temperature-low humidity conditions of 15° C—10% RH.

EXAMPLE 2

Styrene-2-ethylhexyl acrylate copolymer: 100 parts
Rhodamine-type red dye: 10 parts
Substituted guanidine compound (15): 3 parts With 100 g of a toner having the above composition and an average particle size of 9.5 microns was mixed 1000 g of iron powder to form a developer. The toner in the developer showed a good positive chargeability.

The developer was used in a developing apparatus as shown in the accompanying drawing to effect imaging, whereby a good image showing a clear red color was obtained and substantially no change in image density was observed until the toner/carrier ratio reached 10 g/50 g. Thereafter, the imaging was continued for 10,000 sheets while supplying the toner, whereby good images were continually obtained.

The developing method is now explained with reference to the accompanying drawing wherein reference numeral 1 denotes an electrostatic image-bearing member, 2 a toner-carrying member, 3 a hopper, 5 a toner, 6 a developingn bias source, 50 a fixed magnet, 52 a magnetic brush composed of a mixture of iron powder particles and the toner, and 58 a blade for regulating the toner thickness. The magnetic brush 52 formed on the toner-carrying member 2 is caused to circulate to take up therein the toner in the hopper 3, whereby a thin coating layer of the toner is formed on the toner-carrying member 2. The toner-carrying member 2 is disposed to face the electrostatic image-bearing member 1 with a gap therebetween thicker than the toner layer 5, and the toner 5 is caused to jump from the toner carrying member 2 to an electrostatic image on the image-bearing member 1.

The thickness of the toner layer 5 is regulated by the mass or volume of the magnetic brush 52, i.e., the quantity of iron powder as magnetic particles, and the regulating blade 58. The gap between the members is set to be larger than the toner layer thickness and a developing bias voltage may be applied from a source 6, as desired.

In this example, the developer was charged in the developer as shown in the drawing, wherein the gap between the regulating blade 58 and the toner-carrying member 2 was set to be about 250 microns to form a toner layer of about 30 microns in thickness, and the gap between the toner carrying member 2 and the electrostatic image bearing member 1 was set to be 300 microns, whereby the toner was caused to jump onto a negative electrostatic image to effect development under the application of an alternating voltage with peak values of +700 V and −200 V which were obtained by superposing a DC component of 250 V on a DC voltage with a frequency of 200 Hz and peak values of ±450 V.

EXAMPLE 3

Styrene/butyl acrylate (weight ratio=80:20) copolymer (weight average molecular weight Mw: about 300,000): 100 parts
Magnetite EPT-5000 (produced by Toda Kogyo K.K.): 60 parts
Low-molecular weight polypropylene wax: 2 parts
Substituted guanidine compound (15): 2 parts The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine powder with particle sizes of 5–20 microns. Then, 0.4 part of hydrophobic colloidal silica treated with silicone oil having an amino-group in the side chain (produced by Nihon Aerosil K.K.) was admixed with 100 parts of the fine powder as obtained above to prepare a one-component magnetic toner.

The toner was applied to a commercially available laser copier (Trade name: NP-150Z mfd. by Canon K.K.) for imaging, whereby good images were obtained. In the developing stage of the copier, the one-component magnetic toner showed a good positive chargeability. The transfer efficiency was as high as 90% or higher and satisfactory.

COMPARATIVE EXAMPLE 1

A developer was prepared in the same manner as in Example 1 except that 3 parts of a nigrosine dye (Nigrosine EX, produced by Orient Kagaku Kogyo K.K.) was used in place of the 3 parts of the substituted guianidine compound (15), and the developer was subjected to developing, transferring and fixing. At normal temperature and normal humidity, fog occurred little, but the image density was as low as 1.06 with scattering of line images and conspicuous coarsening at the solid black portions. When successive copying test was conducted, the density was lowered to 0.83 on copying of 30,000 sheets. Further, during the successive copying test, the toner material formed a film in the form of thin streaks on the photosensitive member. This is a so-called "filming" phenomenon which is considered to have occurred because the charge controller changed the lubrication characteristic of the toner. Further, during the successive copying, the fixed image surface of recording paper was liable to be caught into fixing rollers and had a difficulty in pealability from the rollers.

When images were obtained under the conditions of 35° C. and 85%, the image density was lowered to 0.88 with increase of fog, scattering of the toner and coarsening of the image. The transfer efficiency was also as low as 69%.

When the images were obtained under the conditions of 10° C. and 10% RH, the image density was as low as 0.91, with excessive scattering, fog an coarsening, and transfer drop-off was markedly observed. Continuous image formation was effected until about 30,000 copies were produced, when the density became 0.53 to be practically unacceptable.

EXAMPLE 4

Styrene/butyl methacrylate (80:20) copolymer: 100 parts
Carbon black: 5 parts
Low-molecular weight polyethylene wax: 2 parts
Substituted guanidine compound (2): 2 parts The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine powder with particle sizes of 5–20 microns. Then, 5 parts of the fine powder was mixed with 100 parts of iron powder carrier having an average particle size of 50–80 microns to prepare a developer.

Then, a negative electrostatic image was formed on an OPC (organic photoconductor) photosensitive member by a known electrophotographic technique and developed with the above prepared developer containing a positively charged toner by the magnetic brush method to form a toner image, which was transferred to plain paper and heat-fixed. The thus obtained image was sufficiently high in density, free of fog and toner scattering around the image, thus found to be a good image with a high resolution.

Further, during a successive copying test, the above-mentioned phenomenon of "filming" on the photosensitive member was not observed, nor was observed any problem during the cleaning step. No trouble was encountered in the fixing step either. After the termination of th 30,000 sheets of the successive coying test, the fixing device was observed, whereas no flaw or damage was observed on the rollers nor was observed almost any staining with offset toner, thus being practically of no problem.

Further, when the environmental conditions were changed to 35° C.–85%, clear images were obtained without fog or scattering, and the image density which was substantially equal to that obtained under the normal temperature-normal humidity was obtained.

Then, when transferred images were obtained under low temperature-low humidity conditions of 15° C.–10%, excellent images could be obtained with a sufficiently high image density and solid black portions could be very smoothly developed without scattering or drop-off in the central parts.

EXAMPLE 5

A developer was prepared in the same manner as in Example 4 except that 3 parts of the substituted guanidine compound (29) was used in place of the 2 parts of the substituted guanidine compound (2), and the obtained developer was similarly subjected to developing, transferring and fixing to obtain images.

Satisfactory results substantially the same as in Example 4 were obtained. Detailed results are shown in Tables 1 and 2.

EXAMPLE 6

A developer was prepared in the same manner as in Example 4 except that 5 parts of the substituted guanidine compound (30) was used in place of the 2 parts of the substituted guanidine compound (2), and the obtained developer was similarly subjected to developing, transferring and fixing to obtain images.

The results are also shown in Tables 1 and 2.

EXAMPLE 7

A developer was prepared in the same manner as in Example 4 except that 2 parts of the substituted guanidine compound (31) was used in place of the 2 parts of the substituted guanidine compound (2), and the obtained developer was similarly subjected to developing, transferring and fixing to obtain images.

The results are also shown in Tables 1 and 2.

EXAMPLE 8

Styrene/butyl methacrylate (80:20) copolymer (weight average molecular weight Mw: about 350,000): 100 parts
Magnetite EPT-5000 (produced by Toda Kogyo K.K.): 60 parts
Low-molecular weight polypropylene wax: 2 parts
Substituted guanidine compound (2): 5 parts The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine powder with a sizes of 5–20 microns. Then, 0.4 part of hydrophobic colloidal silica treated with aminomodified silicone oil (produced by Nihon Aerosil K.K.) was admixed with 100 parts of the fine powder as obtained above to prepare a one-component magnetic toner.

The toner was applied to a commercially available copier (Trade name: NP-150Z, mfd. by Canon K.K.) for imaging, whereby substantially the same results as in Example 4 were obtained.

The results are also shown in Tables 1 and 2.

EXAMPLE 9

A developer was prepared in the same manner as in Example 8 except that 3 parts of the substituted guanidine compound (29) was used in place of the substituted guanidine compound (2), and the obtained developer was similarly subjected to developing, transferring and fixing to obtain images.

The results are also shown in Tables 1 and 2.

EXAMPLE 10

A developer was prepared in the same manner as in Example 4 except that 2 parts of the substituted guanidine compound (30) was used in place of the substituted guanidine compound (2), and the obtained developer was similarly subjected to developing, transferring and fixing to obtain images.

The results are also shown in Tables 1 and 2.

COMPARATIVE EXAMPLE 2

A developer was prepared in the same manner as in Example 8 except that 2 parts of a nigrosine dye (Nigrosine Base EX, produced by Orient Kagaku Kogyo K.K.) was used in place of the substituted guanidine compound (2) and the developer was subjected to developing, transferring and fixing. At normal temperature and normal humidity, fog occurred little, but the image density was as low as 0.81 with scattering of line images and conspicuous coarsening at the solid black portions.

When images were obtained under the conditions of 35° C. and 85%, the image density was lowered to 0.88 with increase of fog, scattering of the toner and coarsening of the image, proving to be practically unacceptable. The transfer efficiency was also low.

When the images were obtained under the conditions of 10° C. and 10% RH, the image density was as low as 0.73, with excessive scattering, fog and coarsening, and transfer drop-off was markedly observed.

EXAMPLE 11

Styrene/butyl methacrylate (80:20) copolymer (weight average molecular weight Mw: about 300,000): 100 parts
Copper phthalocyanine blue pigment: 5 parts
Low-molecular weight polypropylene wax: 2 parts
Substituted guanidine compound (3): 2 parts The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine powder with particle sizes of 5–20 microns. The toner in the developer showed a good positive chargeability.

Then, 100 parts of the fine powder was mixed with 50 parts of magnetic particles having particle sizes of 50–80 microns to prepare a developer.

The developer was used in a developing apparatus as shown in the accompanying drawing to effect imaging, whereby a good image showing a clear blue color was obtained. Substantially no change in image density was observed until the tone/carrier ratio reached 10 parts/50 parts.

The results of evaluation in Examples 4–11 and Comparative Example 2 are shown in the following Tables 1 and 2.

TABLE 1

| | Normal Temperature, Normal Humidity | | | | | |
|---|---|---|---|---|---|---|
| | Image density at initial stage | Fog | Scattering | Reproducibility of thin lines | On successive copying: Filming | On successive copying: Fixation |
| Example | | | | | | |
| 4 | 1.31 | o | o | o | o | o |
| 5 | 1.30 | o | o | o | o | o |
| 6 | 1.32 | o | o | o | o | o |
| 7 | 1.29 | o | o | o | o | o |
| 8 | 1.32 | o | o | o | o | o |
| 9 | 1.30 | o | o | o | o | o |
| 10 | 1.31 | o | o | o | o | o |
| 11 | 1.30 | o | o | o | o | o |
| Comparative Example 2 | 0.81 | x | x | Δ | Δ | Δ |

In the above table and the tables appearing hereinafter, the symbols denote the following.
o: Good Δ: Rather bad x: Bad

TABLE 2

| | 35° C., 85% | | | 15° C., 10% | | |
|---|---|---|---|---|---|---|
| | Image density | Fog | Transfer efficiency | Image density | Fog | Transfer efficiency |
| Example | | | | | | |
| 4 | 1.25 | o | o | 1.30 | o | o |
| 5 | 1.26 | o | o | 1.31 | o | o |
| 6 | 1.24 | o | o | 1.30 | o | o |
| 7 | 1.23 | o | o | 1.26 | o | o |
| 8 | 1.27 | o | o | 1.29 | o | o |
| 9 | 1.24 | o | o | 1.28 | o | o |
| 10 | 1.28 | o | o | 1.27 | o | o |
| 11 | 1.29 | o | o | 1.25 | o | o |
| Comparative Example 2 | 0.72 | x | Δ | 0.73 | Δ | x |

EXAMPLE 12

Styrene/butyl acrylate (80:20) copolymer (weight average molecular weight Mw: about 300,000): 100 parts
Carbon black (Mitsubishi #44): 10 parts
Low-molecular weight polyethylene wax: 2 parts
Substituted guanidine compound (24): 2 parts The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine powder with particle sizes of 5–20 microns. Then, 5 parts of the fine powder was mixed with iron powder carrier having an average particle size of 50–80 microns to prepare a developer. The triboelectric charge of the developer was measured by the ordinary blow-off method.

Then, a negative electrostatic image was formed on an OPC photosensitive member by a known electrophotographic technique and developed with the above prepared developer by the magnetic brush method to form a toner image, which was transferred to plain paper and heat-fixed. The thus tranferred image was sufficiently high in density as high as 1.28, free of fog and toner scattering around the image, thus found to be a good image with a high resolution. The developer was used to form transfer images continuously, whereby transfer images after 30,000 sheets of transferring were not at all inferior to those obtained at the initial stage.

Further, during a successive copying test, the above-mentioned phenomenon of "filming" on the photosensitive member was not observed, nor was observed any problem during the cleaning step. No trouble was encountered in the fixing step either. After the termination of the 30,000 sheets of the successive copying test, the fixing device was observed, whereas no flaw or damage was observed on the rollers, nor was observed almost any staining with offset toner, thus being practically of no problem.

Further when the environmental conditions were changed to 35° C.–85%, clear images were obtained without fog or scattering, and an image density of 1.30 which was substantially equal to that obtained under the normal temperature-normal humidity was obtained.

Then, when transferred images were obtained under low temperature-low humidity conditions of 15° C.–10%, excellent images could be obtained with a sufficiently high image density of 1.36 and solid black portion could be very smoothly developed without scattering or drop-off in the central parts. When copying was conducted continuously and intermittently as a durability test, whereby fluctuation in density was ±0.2 which was within a practically sufficient range.

EXAMPLE 13

A developer was prepared in the same manner as in Example 12 except that 3 parts of the substituted guanidine compound (25) was used in place of the substituted guanidine compound (24), and the obtained developer was similarly subjected to developing, transferring and fixing to obtain images.

The results are also shown in Tables 3 and 4.

EXAMPLE 14

A developer was prepared in the same manner as in Example 12 except that 2 parts of the substituted guanidine compound (27) was used in place of the substituted guanidine compound (24), and the obtained developer was similarly subjected to developing, transferring and fixing to obtain images.

The results are also shown in Tables 3 and 4.

EXAMPLE 15

A developer was prepared in the same manner as in Example 12 except that 2 parts of the substituted guanidine compound (28) was used in place of the substituted guanidine compound (24), and the obtained developer was similarly subjected to developing, transferring and fixing to obtain images.

The results are also shown in Tables 3 and 4.

TABLE 3

| | Normal Temperature, Normal Humidity | | | | | | | |
|---|---|---|---|---|---|---|---|---|
| | Triboelectric Charge at initial | Image | | | Reproducibility of | Density on copying | On successive copying | |
| Example | stage (μC/g) | density | Fog | Scattering | thin lines | 30000 sheets | Filming | Fixation |
| 12 | +11.0 | 1.35 | o | o | o | 1.29 | o | o |
| 13 | +5.2 | 1.22 | o | o | o | 1.20 | o | o |
| 14 | +7.4 | 1.36 | o | o | o | 1.30 | o | o |
| 15 | +10.5 | 1.25 | o | o | o | 1.21 | o | o |

TABLE 4

| | 35° C., 85% | | | | 10° C., 15% | | | |
|---|---|---|---|---|---|---|---|---|
| Example | Image density | Fog | Transfer efficiency (%) | On copying 30000 sheets | Image density | Fog | Transfer efficiency (%) | On copying 30000 sheets |
| 12 | 1.30 | o | 89 | 1.22 | 1.36 | o | 92 | 1.30 |
| 13 | 1.17 | o | 87 | 1.20 | 1.22 | o | 90 | 1.21 |
| 14 | 1.21 | o | 87 | 1.19 | 1.27 | o | 87 | 1.22 |

TABLE 4-continued

| | 35° C., 85% | | | | 10° C., 15% | | | |
|---|---|---|---|---|---|---|---|---|
| Example | Image density | Fog | Transfer efficiency (%) | On copying 30000 sheets | Image density | Fog | Transfer efficiency (%) | On copying 30000 sheets |
| 15 | 1.23 | o | 87 | 1.21 | 1.21 | o | 86 | 1.27 |

EXAMPLE 16

A developer was prepared in the same manner as in Example 12 except that 2 parts of the substituted guanidine compound (1) was used in place of the substituted guanidine compound (24), and the obtained developer was similarly subjected to developing, transferring and fixing to obtain images.

The results are shown in Tables 5 and 6.

EXAMPLE 17

A developer was prepared in the same manner as in Example 12 except that 2 parts of the substituted guanidine compound (3) was used in place of the substituted guanidine compound (24), and the obtained developer was similarly subjected to developing, transferring and fixing to obtain images.

The results are also shown in Tables 5 and 6.

TABLE 5

| | Normal Temperature, Normal Humidity | | | | | | |
|---|---|---|---|---|---|---|---|
| | Image density of initial | | | Reproducibility of | Density on copying | On successive copying | |
| Example | stage | Fog | Scattering | thin lines | 30000 sheets | Filming | Fixation |
| 16 | 1.24 | o | o | o | 1.21 | o | o |
| 17 | 1.26 | o | o | o | 1.19 | o | o |

TABLE 6

| | 35° C., 85% | | | | 15° C., 10% | | | |
|---|---|---|---|---|---|---|---|---|
| Example | Image density | Fog | Transfer efficiency | Density on copying 30000 sheets | Image density | Fog | Transfer efficiency | Density on copying 30000 sheets |
| 16 | 1.19 | o | o | 1.31 | 1.31 | o | o | 1.21 |
| 17 | 1.20 | o | o | 1.35 | 1.31 | o | o | 1.29 |

EXAMPLE 18

The substituted guanidine compound (40) in an amount of 100 g was dissolved or dispersed in 1 liter of methyl ethyl ketone, in which was further added 1 kg of iron powder carrier (particle size: 250–400 mesh). The mixture was further stirred for about 30 minutes in a ball mill and the mixture, after removal of the solvent, was dried and crushed to disintegrate a slight agglomeration thereby to obtain a treated iron powder carrier improved in charge-imparting ability.

Separately, 100 parts of a styrene resin (Trade name: D-125, mfd. by Shell Chemical Co.) and 6 parts of carbon black (Trade name: Raven 3500, mfd. by Cabot Co.) were kneaded, crushed and classified to prepare a toner having sizes of 1–30 microns. This toner and the above mentioned treated iron powder carrier was mixed in a weight ratio of 10:100. The triboelectric charge of the thus obtained developer was measured by the blow off method to be $-11.5\ \mu C/g$.

The developer was used for imaging by means of a copying machine (NP-5000, mfd. by Canon K.K.). As a result, copied images were obtained with very little variation in image density, good reproducibility of thin line images and good gradation and without fog, even after 50000 sheets of successive copying test.

EXAMPLE 19

The procedure of Example 18 was repeated except that the substituted guanidine compound (24) was used in place of the substituted guanidine compound (40) to prepare a developer, and the developer was used in 50,000 sheets of the successive copying test, whereby good results were similarly obtained.

The triboelectric charge of the toner in the developer was measured by the flow-off method to be $-10.4\ \mu C/g$.

EXAMPLE 20

In 1 liter of xylene was dissolved 100 g of polymethyl methacrylate resin and further mixed with 50 g of the substituted guanidine compound (41). The solution was fully mixed with 1 kg of iron powder carrie (particle size: 250–400 mesh). The mixture, after removal of the solvent, was dried and crushed to distintegrate a slight agglomeration thereby to obtain a treated iron powder carrier improved in charge-imparting ability.

The thus treated iron powder carrier in an amount of 100 parts was mixed with 10 parts of the toner used in Example 18 to prepare a developer. The developer was used in 50,000 sheets of the successive copying test, whereby good image density, reproducibility of thin line images and gradation which were substantially the same as those at the initial stages were obtained without accompanying fog.

The triboelectric charge of the toner in the developer was measured to be $-10.8\ \mu C/g$.

EXAMPLE 20

The procedure of Example 20 was repeated except that the substituted guanidine compound (28) was used in place of the substituted guanidine compound (41) to prepare a developer, and the developer was used in 50,000 sheets of the successive copying test, whereby good results were similarly obtained.

The triboelectric charge of the toner in the developer was measured by the flow-off method to be $-9.5\ \mu C/g$.

EXAMPLE 22

In 1 liter of xylene was dissolved 100 g of polymethyl methacrylate resin and further mixed with 50 g of the substituted guanidine compound (42). Into the solution thus obtained was dipped a developing sleeve (made of stainless steel) for a copier (NP-400RE, Canon K.K.), and the solvent was removed to form a coating film at a rate of 0.1 to 0.6 mg/cm$^2$. The thus coated sleeve was affixed to a developing apparatus for the copier (NP-400RE) and was used for a test explained hereinafter.

Separately, the following ingredients were kneaded, crushed and classified to prepare a toner having particle sizes of 1 to 30 microns.

Styrene/butyl methacrylate copolymer: 100 parts (Mw=300,000)
Low-molecular weight polyethylene: 4 parts (Trade name: PE-130, mfd. by Hoechest A.G.)
Magnetite: 60 parts (Trade name: BL-200, mfd. by Titan Kogyo K.K.)

The thus prepared toner was subjected to a successive imaging test by means of the above-mentioned developing apparatus provided with the coated sleeve. During 50,000 sheets of successive imaging, images were obtained without change from the initial stage, with good reproducibility of thin lines and good gradation and with substantially no fog.

The surface potential on the sleeve was measured to be −34 V, and the toner was confirmed to be completely negatively charged.

EXAMPLE 23

The procedure of Example 22 was repeated except that the substituted guanidine compound (51) was used in place of the substituted guanidine compound (42), to prepare a coated sleeve. The coated sleeve was used in 50,000 sheets of the successive copying test, whereby good results were obtained.

The surface potential on the sleeve was measured to be −35 V, and the toner was confirmed to be completely negatively charged.

EXAMPLE 24

The procedure of Example 22 was repeated except that the substituted guanidine compound (22) was used in place of the substituted guanidine compound (42), to prepare a coated sleeve. The coated sleeve was used in 50,000 sheets of the successive copying test, whereby good results were obtained.

The surface potential on the sleeve was measured to be −24 V, and the toner was confirmed to be completely negatively charged.

EXAMPLE 25

In 1 liter of xylene was dissolved 100 g of polycarbonate resin and further mixed with 20 g of the substituted guanidine compound (43). Into the solution thus obtained was dipped a developing sleeve (made of aluminum) for a blue cartridge of a copier (PC-20, Canon K.K.), and the solvent was removed to form a coating film at a rate of 0.1 to 0.5 mg/cm$^2$. The thus coated sleeve was affixed to the developing apparatus for the copier and was used for a test explained hereinafter.

Separately, the following ingredients were kneaded, crushed and classified to prepare a toner having particle sizes of 1 to 30 microns.

Styrene/butyl methacrylate copolymer: 100 parts (Mw=150,000)
Low-molecular weight polyethylene: 4 parts (Trade name: PE-130, mfd. by Hoechest A.G.)
Blue colorant (Phthalocyanine pigment): 6 parts The thus prepared toner was subjected to a successive imaging test by means of the above-mentioned developing apparatus provided with the coated sleeve and adjusted to effect reversal development.

As a result, clear blue images were obtained with good reproducibility of thin lines and gradation until the toner was consumed.

The surface potential of the toner on the sleeve was measured to be −3 V, and the toner was negatively charged.

EXAMPLE 26

The procedure of Example 25 was repeated except that the substituted guanidine compound (58) was used in place of the substituted guanidine compound (43), to prepare a coated sleeve. The coated sleeve was used in the successive imaging test, whereby good results were obtained.

The surface potential on the sleeve was measured to be −21 V, and the toner was confirmed to be negatively charged.

EXAMPLE 27

The procedure of Example 25 was repeated except that the substituted guanidine compound (28) was used in place of the substituted guanidine compound (42), to prepare a coated sleeve. The coated sleeve was used in the successive imaging test, whereby good results were obtained.

The surface potential on the sleeve was measured to be −31 V, and the toner was confirmed to be negatively charged.

What is claimed is:

1. A positively chargeable dry toner for developing electrostatic images, comprising: a binder resin, a colorant or a magnetic material and a substituted guanidine compound having at least one substituent group, said substituted guanidine compound being represented by the following formula (I):

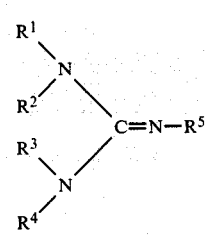

wherein $R^1$, $R^2$, $R^3$, $R^4$ and $R^5$ are the same or different groups including hydrogen atom, alkyl, cycloalkyl, alkenyl, aryl, aralkyl, alkaryl, and heterocyclic groups, of which a hydrogen atom may be further replaced by a substituent group, and at least one of $R^1$, $R^2$, $R^3$, $R^4$ and $R^5$ is a group other than hydrogen, in which said substituted guanidine compound is contained in a proportion of 0.1 to 10 parts by weight per 100 parts by weight of said binder resin.

2. The toner according to claim 1, wherein said substituted guanidine compound is a compound represented by the following formula (II):

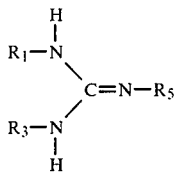

(II)

wherein $R^1$ and $R^3$ are respectively an aryl group, and $R^5$ is hydroegn atom, an alkyl group or an aryl group.

3. The toner according to claim 2, wherein $R^1$ and $R^3$ are the same or different groups selected from aryl groups respectively having 6–30 carbon atoms.

4. The toner according to claim 2, wherein $R^5$ is an alkyl group having 1–20 carbon atoms or an aryl group having 6–30 carbon atoms.

5. The toner according to claim 1, wherein said binder resin comprises a copolymer of two or more members selected from the group consisting of styrene, acrylates and methacrylates.

6. The toner according to claim 1, which has an average particle size of 5 to 20 microns.

7. The toner according to claim 1, wherein the magnetic material is used in an amount of 20 to 200 parts by weight per 100 parts by weight of the binder resin.

8. The toner according to claim 7, wherein the magnetic material has an average particle size of 0.1 to 2 microns.

9. The toner according to claim 1, wherein the colorant is a dye or pigment selected from the group consisting of Carbon Black, Lamp Black, Iron Black, ultramarine blue, Aniline Blue, Phthalocyanine Blue, Phthalocyanine Green, Hansa Yellow G, Rhodamine 6G Lake, Chalcooil Blue, Chrome Yellow, Quinacridone, Benzidine Yellow Rose Bengal, triarylmethane dyes, monoazo and disazo dyes.

10. The toner according to claim 1, wherein the binder resin is a polymer selected from the group consisting of styrene homopolymer, styrene derivative homopolymer, styrene copolymer, polyvinyl chloride, polyvinyl acetate, polyethylene, polypropylene, polyesters, polyurethanes, polyamides, epoxy resins, polyvinyl butyral, polyacrylic acid resin, rosin, modified rosins, terpene resin, phenolic resins, aliphatic or alicyclic hydrocarbon resins, aromatic petroleum resin, chlorinated paraffin, and paraffin wax.

11. The toner according to claim 5, wherein the binder resin is a polymer selected from the group consisting of styrene-acrylate copolymer, styrene-methacrylate copolymer, acrylate-methacrylate copolymer, a copolymer of two or more acrylates and a copolymer of two or more methacrylates.

12. The toner according to claim 11, wherein the binder resin is a copolymer selected from the group consisting of styrene-butyl methacrylate copolymer, styrene-2-ethylhexyl acrylate copolymer, and styrene-butyl acrylate copolymer.

* * * * *

UNITED STATES PATENT AND TRADEMARK OFFICE

CERTIFICATE OF CORRECTION

PATENT NO. : 4,663,263

DATED : May 5, 1987

INVENTOR(S) : TAKESHI IKEDA, ET AL.

It is certified that error appears in the above-identified patent and that said Letters Patent is hereby corrected as shown below:

COLUMN 1

Line 21, "quani-" should read --guani- --.

COLUMN 2

Line 39, "controlling more" should read --controlling agent more--.
Line 46, "properly" should read --property--.
Line 65, "copyng." should read --copying.--.
Line 65, "Further a" should read --Further, a--.

COLUMN 3

Line 11, "dissolution" should read --solution--.
Line 24, "movement or" should read --movement- or--.
Line 32, "toner a" should read --toner to--.
Line 54, "charge imparting" should read --movement-regulating material--.
Line 59, "dissolving" should read --solving--.
Line 59, "above men-" should read --above-men- --.

COLUMN 4

Line 7, "half tone" should read --halftone--.
Line 16, "A still another" should read --Still another--.
Line 17, "be" should be deleted.
Line 47, "of" should be deleted.

UNITED STATES PATENT AND TRADEMARK OFFICE

CERTIFICATE OF CORRECTION

PATENT NO. : 4,663,263

DATED : May 5, 1987

INVENTOR(S) : TAKESHI IKEDA, ET AL.

It is certified that error appears in the above-identified patent and that said Letters Patent is hereby corrected as shown below:

COLUMN 5

Line 9, "above men-" should read --above-men- --.
Line 68, "(II)" should read --(II):--.

COLUMN 9

Line 56, "C" should read --C--.

$H_3$ $H_3$

Line 64, "C" should read --C--.

$H_3$ $H_3$

COLUMN 15

Line 9, "oisopropylaniline" should read --o-isopropylaniline--.
Line 14, "poin" should read --point--.
Line 16, "(60) may" should read --(60)) may--.

COLUMN 17

Line 10, "resins);" should read --resins;--.

COLUMN 18

Line 5, "resin the" should read --resin and the--.
Line 22, "obviated such" should read --obviated, such--.

UNITED STATES PATENT AND TRADEMARK OFFICE

CERTIFICATE OF CORRECTION

PATENT NO. : 4,663,263

DATED : May 5, 1987

INVENTOR(S) : TAKESHI IKEDA, ET AL.

It is certified that error appears in the above-identified patent and that said Letters Patent is hereby corrected as shown below:

COLUMN 19

Line 14, "may" should read --there may--.
Line 27, "particles a" should read --particles, a--.

COLUMN 20

Line 34, "developingn" should read --developing--.

COLUMN 21

Line 34, "guianidine" should read --guanidine--.
Line 50, "pealability" should read --peelability--.
Line 58, "an" should read --and--.

COLUMN 22

Line 15, "above prepared" should read --above-prepared--.
Line 27, "th" should read --the--.
Line 28, "whereas" should read --whereat--.

COLUMN 23

Line 19, "a" should be deleted.
Line 21, "aminomodified" should read --amino-modified--.

COLUMN 25

Line 37, "above" should read --above- --.
Line 40, "tranferred" should read --transferred--.

UNITED STATES PATENT AND TRADEMARK OFFICE

CERTIFICATE OF CORRECTION

PATENT NO. : 4,663,263

DATED : May 5, 1987

INVENTOR(S) : TAKESHI IKEDA, ET AL.

It is certified that error appears in the above-identified patent and that said Letters Patent is hereby corrected as shown below:

COLUMN 26

Line 4, "whereas" should read --whereat--.
Line 8, "Further when" should read --Further, when--.

COLUMN 27

Line 61, "above mentioned" should read --above-mentioned--.
Line 64, "blow off" should read --blow-off--.

COLUMN 28

Line 19, "flow-off" should read --blow-off--.
Line 44, "carrie" should read --carrier--.
Line 59, "EXAMPLE 20" should read --EXAMPLE 21--.
Line 68, "flow-off" should read --blow-off--.

COLUMN 29

Line 18, "Hoechest" should read --Hoechst--.

COLUMN 30

Line 2, "Hoechest" should read --Hoechst--.
Line 30, "(42)," should read --(43),--.

UNITED STATES PATENT AND TRADEMARK OFFICE

CERTIFICATE OF CORRECTION

PATENT NO. : 4,663,263

DATED : May 5, 1987

INVENTOR(S) : TAKESHI IKEDA, ET AL.

It is certified that error appears in the above-identified patent and that said Letters Patent is hereby corrected as shown below:

COLUMN 32

Line 7, "Yellow Rose" should read --Yellow, Rose--.

Signed and Sealed this

Fifteenth Day of September, 1987

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,663,263

DATED : May 5, 1987

INVENTOR(S) : TAKESHI IKEDA ET AL.

It is certified that error appears in the above-identified patent and that said Letters Patent is hereby corrected as shown below:

Column 8, line 5:

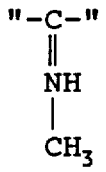

should read:

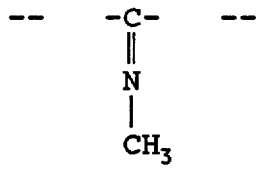

Signed and Sealed this

Eighteenth Day of December, 1990

*Attest:*

HARRY F. MANBECK, JR.

*Attesting Officer*

*Commissioner of Patents and Trademarks*